US010783774B2

(12) United States Patent
Zhong et al.

(10) Patent No.: US 10,783,774 B2
(45) Date of Patent: Sep. 22, 2020

(54) METHOD FOR ESTIMATING ROAD TRAVEL TIME BASED ON BUILT ENVIRONMENT AND LOW-FREQUENCY FLOATING CAR DATA

(71) Applicant: Dalian University of Technology, Dalian, Liaoning Province (CN)

(72) Inventors: Shaopeng Zhong, Dalian (CN); Haimin Jun, Dalian (CN); Yanquan Zou, Dalian (CN); Kun Wang, Dalian (CN); Kangli Zhu, Dalian (CN)

(73) Assignee: DALIAN UNIVERSITY OF TECHNOLOGY, Dalian, Liaoning (CN)

( * ) Notice: Subject to any disclaimer, the term of this patent is extended or adjusted under 35 U.S.C. 154(b) by 232 days.

(21) Appl. No.: 16/076,109

(22) PCT Filed: Oct. 11, 2017

(86) PCT No.: PCT/CN2017/105633
§ 371 (c)(1),
(2) Date: Aug. 7, 2018

(87) PCT Pub. No.: WO2018/103449
PCT Pub. Date: Jun. 14, 2018

(65) Prior Publication Data

US 2019/0156662 A1 May 23, 2019

(30) Foreign Application Priority Data

Dec. 9, 2016 (CN) ..... 2016 1 1127783

(51) Int. Cl.
*G08G 1/01* (2006.01)

(52) U.S. Cl.
CPC ..... *G08G 1/0112* (2013.01); *G08G 1/0125* (2013.01); *G08G 1/0129* (2013.01); *G08G 1/0141* (2013.01)

(58) Field of Classification Search
CPC .. G08G 1/0112; G08G 1/0129; G08G 1/0125; G08G 1/0141
See application file for complete search history.

(56) References Cited

U.S. PATENT DOCUMENTS 6,813,555 B1 * 11/2004 Kerner ..... G08G 1/0104 701/117
8,818,380 B2 * 8/2014 Feldman ..... H04W 64/00 455/443
2001/0014847 A1 * 8/2001 Keenan ..... G08G 1/01 701/117
2002/0120390 A1 * 8/2002 Bullock ..... G08G 1/096838 701/117
2006/0089787 A1 * 4/2006 Burr ..... G08G 1/096883 701/533
2006/0122846 A1 * 6/2006 Burr ..... G08G 1/20 342/357.31
2007/0010934 A1 * 1/2007 Breitenberger ..... G08G 1/0104 701/117
2009/0080973 A1 * 3/2009 Bespalov ..... G08G 1/0129 404/72
2009/0287405 A1 * 11/2009 Liu ..... G01C 21/20 701/119
2010/0328100 A1 * 12/2010 Fujiwara ..... G08G 1/0129 340/905
2011/0153202 A1 * 6/2011 Sengoku ..... G01C 21/3469 701/533
2011/0276592 A1 * 11/2011 Gautama ..... G01C 21/32 707/769
2014/0052373 A1 * 2/2014 Hoch ..... G08G 1/096822 701/533
2014/0052374 A1 * 2/2014 Hoch ..... G01C 21/362 701/533
2015/0012206 A1 * 1/2015 Wiebel ..... G08G 1/0112 701/119
2015/0061550 A1 * 3/2015 Schulz ..... B60L 50/10 318/376
2016/0012722 A1 * 1/2016 Filali ..... G08G 1/0116 701/118
2016/0025510 A1 * 1/2016 Belzner ..... G08G 1/0112 701/533
2017/0228683 A1 * 8/2017 Hu ..... G08G 1/00

FOREIGN PATENT DOCUMENTS

CN 101727746 A 6/2010
CN 104778834 A 7/2015
CN 105185103 A 12/2015
CN 105679021 A 6/2016
CN 106781648 A 5/2017
WO WO 2013190233 A1 12/2013

* cited by examiner

*Primary Examiner* — Mussa A Shaawat
(74) *Attorney, Agent, or Firm* — Muncy, Geissler, Olds & Lowe, P.C.

(57) ABSTRACT

A method for estimating road travel time based on the built environment and low-frequency floating car data belongs to the technical field of urban traffic management and traffic system evaluation. The method takes built environment as an explanatory variable of the road travel time. The interpretability of this variable is proved by a numerical example. In addition, the method determines distribution parameters of road travel time using the number distribution of vehicles instead of distance. The benefits of the method are that: (1) it explains the positive effect of built environment on road travel time; and (2) it reflects the speed difference among different road sections, which can improve the precision of estimating road travel time.

1 Claim, No Drawings

METHOD FOR ESTIMATING ROAD TRAVEL TIME BASED ON BUILT ENVIRONMENT AND LOW-FREQUENCY FLOATING CAR DATA

TECHNICAL FIELD

The present invention belongs to an area of urban traffic management and traffic system evaluation, which are concerned with intelligent traffic systems(ITS) and advanced traveler information systems (ATIS). It particularly relates to the explanation of built environment on road travel time and an estimation method of road travel time.

BACKGROUND

Liu H X proposes a method for predicting travel time on a signal controlled road by using floating car data in combination with traditional loop data and signal lamp phase information. Hellinga B divides each observed total travel time into free-flow time, control delay and congestion delay, and explores how to assign running time of a floating car between two reports to corresponding road sections. Rahmani M et al. propose a non-parameter method for estimating path-based travel time based on floating cars whose trajectories coincide with the route to be studied. They assume that speeds of vehicles on paths and trajectories are stable so that the travel time that vehicles spend on each road section is in direct proportional to distance they traveled during this time.

SUMMARY

This invention aims to estimate the distribution of road travel times within and between road sections using a number of vehicles on the road, used to establish a history travel time database, and which is the distribution coefficients of travel time instead of distance.

The Technical Solution of the Present Invention

A method for estimating road travel time based on the built environment and low-frequency floating car data are presented as following:

(1) Establishing a Relationship Between a Number of Report Sent by Floating Cars and Running Time:

the running time is longer when the road section is congested, and floating cars send a report under this situation; taking an invent of a floating car sending a report as a random variable, the relationship between a detected number of reports sent by floating cars at each point and the running time at this point is established;

the probability of a floating car sending a report at one point is the same, since floating car sends reports at regular intervals; setting the frequency of the floating car sending a report at each moment as ε, then $$\varepsilon = \frac{1}{T}$$

where T is time interval between two reports;

the probability $\rho_x$ of a floating car reporting a position at point x is in direct proportional to the running time of the floating car at point x:

$$\rho_x = \varepsilon t(x) = \frac{t(x)}{T}, \text{ where } t(x) < T$$

if the stay time t(x) for a floating car at some point is longer than u report sending periods, i.e., t(x)>uT, where $u \in N_+$ and $$u = \left[\frac{t(x) - T}{T}\right],$$

then u is the minimum number of report sending; and the probability $\rho_x$ of a float car sending reports u+1 times at point x is $$\rho_x = \varepsilon(t(x) - uT) = \frac{t(x) - uT}{T}$$

assuming that traffic conditions are unchanged during a studied period of time, the running time of a floating car at each point is unchanged; taking the event of floating cars passing each point as a random event, and supposing that floating cars perform the same during the studied period, the events of floating cars passing by are considered as independent repeated experiments and are in accordance with Bernoulli distribution.

thus, when t(x)<T, the probability $p_x$ of a floating car sending $n_x$ reports at point x is $$p_x(N = n_x) = C_m^{n_x} \rho_x^{n_x} (1 - \rho_x)^{m - n_x} = C_m^{n_x} \left(\frac{t(x)}{T}\right)^{n_x} \left(1 - \left(\frac{t(x)}{T}\right)\right)^{m - n_x}$$

when t(x)>uT, where $u \in N_+$, m is estimated number of cars, the probability $p_x$ of a floating car sending $n_x$ reports at point x is $$p_x(N = n_x) = C_m^{n_x - mu} \rho_x^{n_x - mu} (1 - \rho_x)^{m - n_x + mu} = C_m^{n_x - mu} \left(\frac{t(x) - uT}{T}\right)^{n_x - mu} \left(1 - \left(\frac{t(x) - uT}{T}\right)\right)^{m - n_x + mu}$$

where $0 < n_x - mu < m$, i.e., $mu < n_x < m(u+1)$; the difference of times that a car send reports on each section is assumed as once at most herein; this assumption is reasonable considering that the present invention uses low-frequency floating car data.

(2) Establishing a Relationship Between Running Time, Built Environment and Intersection:

a road is divided into a number of sections; the running time of each section depends on its observed and unobserved attributes, including the distance from a section to its downstream intersection, the distance from a section to a crosswalk, and attributes of the road to which the section belongs (such as lane width, the number of lanes, geometric linearity, etc.); particularly, the influence of built environment attributes on speed of the section is considered in this invention, such as interference to motor vehicles caused by pedestrians or other vehicles passing in and out on the speed of the section;

a linear structure is used to represent the influences of the explanatory variables associated with the section running time (regulatory factors such as road grade, geometric linearity of the road and nearby land use attributes) and the length of the specific section on the section running time t'(x), i.e., $$t'(x) = \sum_j \alpha_j A_j \forall x \in X$$

where X represents a road; x is one of the sections; $A_j$ represents the value of each explanatory variable affecting the section running time, such as road grade, the distance to the downstream intersection, etc.; $\alpha_j$ are parameters to be estimated which reflect the influence degree of each explanatory variable on the section running time;

the observed value of a road running time is $t_{ok}, \forall k \in K$, where k is the observed value of a certain running time, and K is a set of values of the running time; the observed running time of each road is the sum of the running time of each section; the relationship between the observed road and the section is represented with a K×X incidence matrix R, where $r_{kx}$ is a ratio of the length of each observed value k passing by section x to the total length of the section.

$$t_{ok} = \sum_x t'(x) \times r_{kx} \forall k \in K$$

the relationship between running time, built environment and intersection is established above by linear combination; thus, an estimation of the running time of each section is converted to a maximum likelihood estimation problem:

$$\begin{aligned}\max \prod_x p_x &= \prod_x C_m^{n_x} \rho_x^{n_x} (1-\rho_x)^{m-n_x} \\ &= C_m^{n_x}\left(\frac{t'(x)}{T}\right)^{n_x}\left(1-\left(\frac{t'(x)}{T}\right)\right)^{m-n_x} \\ &= \prod_x C_m^{n_x} \rho_x^{n_x} (1-\rho_x)^{m-n_x} \\ &= C_m^{n_x}\left(\frac{\sum_j \alpha_j A_j}{T}\right)^{n_x}\left(1-\left(\frac{\sum_j \alpha_j A_j}{T}\right)\right)^{m-n_x}\end{aligned}$$

where $\alpha_j$ are parameters to be estimated; m is estimated number of cars; $n_x$ is number of cars which send a report;

the value of each parameter is obtained by solving the model above, and the running time of each section is calculated using the following equation:

$$t'(x) = \sum_j \alpha_j A_j \forall x \in X;$$

then, the running time of the road is calculated according to the incidence matrix of the road and the sections;

(3) Distributing the Travel Time of Road Section:

the travel time within a section is distributed as follows:

the total running time T on a road is an integral of the running time t"(x) at each point along the road, i.e., $T=\int_0^l t''(x)dx$;

the running time $t_1$ of a section within the road is an integral of the running time at each point along the section, i.e., $t_1=\int_{l_1}^{l_2} t''(x)dx$;

the expected value of the number of cars sending reports at a point is equal to a product of the probability p(x) of cars sending a report at the point and the number of tests (i.e., the total number m of cars that pass the point): E(x)=mp(x);

the observed number $n_x$ of cars which report the positions at point x is an unbiased estimate of the expected value; in addition, the running time of a floating car at a point is in direct proportional to the probability that it reports the position at this point; therefore, it is reasonable to consider that the running time of a floating car at a point is proportional to the number of times it reports its position at this point on the road, i.e., $t(x) \propto p(x) \propto E(x) \propto n_x$;

dividing a road into several sections, and counting the number of times floating cars reporting their positions, then the ratio of the running time of each section to the total running time of the road is equal to the ratio of the total number of times that cars send reports on the section to the total number of times n(x) that cars on the road send reports;

$$\alpha_1 = \frac{t_1}{T} = \frac{\int_{l_1}^{l_2} t''(x)dx}{\int_0^L t''(x)dx} = \frac{\int_{l_1}^{l_2} n(x)dx}{\int_0^L n(x)dx}$$

where $\alpha_1$ is a ratio of the running time of the first section to total running time of the road; $t_1$ is running time of the first section; $l_1$ and $l_2$ are the starting points of the first section and the second section, respectively; L is end point of the last section.

the travel time between different sections is distributed as follows:

the event of floating cars passing by any point of two or more sections is an independent repeated test under the same traffic condition; a ratio of the running times of two sections is equal to that of the total number of reports sent by floating cars that pass through both of these two sections:

$$\frac{T_1}{T_2} = \frac{\int_0^{L_1} n'(x)dx}{\int_0^{L_1} n'(x)dx}$$

where $T_1$ and $T_2$ are running time of two sections, respectively; $L_1$ and $L_2$ are length of the two sections, respectively.

The beneficial effects of this invention are as follows: first, built environment attributes are added as explanatory variables of the road running time and prove the interpretability of built environment for the road running time; second, the running time at intersection is added as a part of road travel time and the distance from the intersection is taken as an explanatory variable, which consider the influence of traffic management and control facilities at the intersection on the running time; third, a method for estimating the distribution coefficients of travel time within and between the road sections is developed based on the distribution of the number of cars on the road sections, which establishes a history database of travel time and improves the precision of estimation results of the road travel time.

DETAILED DESCRIPTION

Detailed steps and simulated effects of the present invention are described as follows.

A method for estimating road travel time based on built environment and low-frequency floating car data consists of the following steps:

1. Calculate the Value of Parameters Corresponding to the Variables that Affect the Running Time of Road Sections in Different Periods The design level, geometric linearity and the number of lanes of each section are set as a parameter, which is equivalent to the running time in a study period when the section is far away from intersection and various facilities. Other factors affecting the running time include intersection, signal control, roadside built environment with large pedestrian flow, parking lots, gas stations. The intersections, schools, hospitals, clinics and gas stations are selected as five types of facilities which have an influence on running time. Distances between each section and the facilities are set as variables which are decreasing functions of distance, because the closer the distance to the facilities, the greater the impact. It is believed that sections more than one kilometer away from facilities are not affected by these facilities anymore since the influence of the facilities is neglected when the sections are far away from the facilities to a certain extent. The value of a distance variable of each section within one kilometer is 1-distance/1000, while the distance variable of each section beyond one kilometer is 0. It should be noted that for a given road section, only the distance to one downstream intersection is selected as a variable. If signalized intersections, non-signal intersections or other different forms of intersections are regarded as parameters respectively, the number of intersection variables of any road section should be less than or equal to 1.

The division period is 10 minutes, so the values of a set of variables are obtained every ten minutes. The three groups of time between 6:00 and 6:30 are merged into one because the data of floating cars during this period is relatively less and the estimated values of running time have little difference during trial tests. Table 1 shows the estimated coefficients of travel time.

TABLE 1

Estimated coefficients of parameters of travel time

| Time | ID1 | ID2 | ID3 | ID4 | ID5 | ID6 | ID7 | ID8 | ID9 | ID10 | ID11 |
|---|---|---|---|---|---|---|---|---|---|---|---|
| 6:00-6:30 | 0.000 | 0.177 | 0.035 | 0.087 | 0.151 | 0.127 | 0.054 | 0.105 | 0.237 | 0.169 | 0.052 |
| 6:30-6:40 | 0.000 | 0.259 | 0.096 | 0.100 | 0.192 | 0.171 | 0.088 | 0.124 | 0.145 | 0.140 | 0.126 |
| 6:40-6:50 | 0.050 | 0.257 | 0.122 | 0.120 | 0.161 | 0.080 | 0.088 | 0.115 | 0.213 | 0.207 | 0.058 |
| 6:50-7:00 | 0.000 | 0.214 | 0.126 | 0.145 | 0.217 | 0.106 | 0.095 | 0.136 | 0.271 | 0.050 | 0.042 |
| 7:00-7:10 | 0.000 | 0.201 | 0.127 | 0.135 | 0.181 | 0.159 | 0.073 | 0.127 | 0.268 | 0.174 | 0.141 |
| 7:10-7:20 | 0.000 | 0.178 | 0.085 | 0.116 | 0.211 | 0.168 | 0.123 | 0.143 | 0.058 | 0.205 | 0.129 |
| 7:20-7:30 | 0.044 | 1.349 | 0.143 | 0.141 | 0.275 | 0.077 | 0.126 | 0.159 | 0.151 | 0.174 | 0.144 |
| 7:30-7:40 | 0.000 | 0.277 | 0.133 | 0.087 | 0.247 | 0.030 | 0.102 | 0.187 | 0.000 | 0.140 | 0.104 |
| 7:40-7:50 | 0.000 | 0.321 | 0.147 | 0.119 | 0.269 | 0.541 | 0.087 | 0.169 | 0.000 | 0.248 | 0.133 |
| 7:50-8:00 | 0.000 | 0.325 | 0.104 | 0.105 | 0.283 | 0.151 | 0.077 | 0.155 | 0.160 | 0.154 | 0.151 |

| Time | ID12 | ID13 | ID14 | ID15 | ID16 | Intersection | School | Hospital | Clinic | Gas station |
|---|---|---|---|---|---|---|---|---|---|---|
| 6:00-6:30 | 0.036 | 0.215 | 0.067 | 0.108 | 0.135 | 0.047 | 0.041 | 0.038 | 0.064 | 0.064 |
| 6:30-6:40 | 0.045 | 0.182 | 0.090 | 0.109 | 0.125 | 0.059 | 0.015 | 0.056 | 0.052 | 0.020 |
| 6:40-6:50 | 0.061 | 0.121 | 0.097 | 0.102 | 0.164 | 0.055 | 0.006 | 0.071 | 0.038 | 0.013 |
| 6:50-7:00 | 0.092 | 0.186 | 0.130 | 0.153 | 0.250 | 0.009 | 0.024 | 0.004 | 0.040 | 0.031 |
| 7:00-7:10 | 0.107 | 0.188 | 0.137 | 0.182 | 0.193 | 0.000 | 0.006 | 0.067 | 0.075 | 0.071 |
| 7:10-7:20 | 0.094 | 0.219 | 0.141 | 0.155 | 0.251 | 0.029 | 0.017 | 0.112 | 0.059 | 0.018 |
| 7:20-7:30 | 0.125 | 0.253 | 0.102 | 0.166 | 0.143 | 0.040 | 0.000 | 0.101 | 0.053 | 0.000 |
| 7:30-7:40 | 0.132 | 0.104 | 0.117 | 0.129 | 0.260 | 0.015 | 0.002 | 0.118 | 0.116 | 0.003 |
| 7:40-7:50 | 0.133 | 0.105 | 0.118 | 0.159 | 0.160 | 0.014 | 0.001 | 0.116 | 0.090 | 0.040 |
| 7:50-8:00 | 0.107 | 0.167 | 0.132 | 0.147 | 0.219 | 0.000 | 0.000 | 0.176 | 0.101 | 0.074 |

The coefficients of first 16 variables correspond to the running time in the study period when the road section is far away from intersections and various facilities. The coefficients of intersections, schools, hospitals, clinics and gas stations variables indicate the increased running time for each built environment when the distance between a road sections and various facilities is less than one kilometer. The coefficients of all variables are positive, which means that the road section running time has a positive correlation with the built environment.

Table 2 compares the difference of the opposite value of the logarithm of the maximum likelihood function between whether the surrounding built environment attributes are added as explanatory variables or not. As can be seen from the table, the minimum likelihood ratio−2(LL−L0)=30 with 5 degree of freedom and $\chi^2$=11.071 when $\alpha$=0.05, which shows reasonability of taking the built environment as an explanatory variable.

TABLE 2

Comparison of opposite value (−LL) of logarithms of values of maximum likelihood functions with and without explanatory variable of built environment

| | Time | | | | | | | | | |
|---|---|---|---|---|---|---|---|---|---|---|
| | 6:00-6:30 | 6:30-6:40 | 6:40-6:50 | 6:50-7:00 | 7:00-7:10 | 7:10-7:20 | 7:20-7:30 | 7:30-7:40 | 7:40-7:50 | 7:50-8:00 |
| Including explanatory variable of built environment | 2704 | 1554 | 1784 | 2071 | 1723 | 1710 | 1658 | 2644 | 2658 | 2691 |
| Excluding explanatory variable of built environment | 2761 | 1572 | 1799 | 2091 | 1744 | 1744 | 1673 | 2660 | 2677 | 3436 |
| 2(LL − L0) | 114 | 36 | 30 | 40 | 42 | 68 | 30 | 32 | 38 | 1490 |

2. Calculate the Running Time of a Path

Table 3 presents the running time from First Company of Dandong Public Transport Corporation to Dandong Research Academy of Environmental Sciences along Jinshan Avenue based on the obtained parameters. It also sees an increase running time from 6:00 to 8:00.

TABLE 3

Changes of running time from First Company of Dandong Public Transport Corporation to Dandong Research Academy of Environmental Sciences along Jinshan Avenue over time

| Time | Travel speed | Travel time | Total passed distance |
|---|---|---|---|
| 6:00-6:30 | 35.77 | 277.11 | 2753.63 |
| 6:30-6:40 | 34.14 | 290.37 | 2753.63 |
| 6:40-6:50 | 35.25 | 281.23 | 2753.63 |
| 6:50-7:00 | 27.40 | 361.78 | 2753.63 |
| 7:00-7:10 | 26.04 | 380.63 | 2753.63 |
| 7:10-7:20 | 26.98 | 367.37 | 2753.63 |
| 7:20-7:30 | 20.78 | 477.04 | 2753.63 |
| 7:30-7:40 | 20.83 | 476.02 | 2753.63 |
| 7:40-7:50 | 21.09 | 469.93 | 2753.63 |
| 7:50-8:00 | 24.67 | 401.81 | 2753.63 |

The obtained time is basically consistent with "about 2.8 km/5 min" measured by Baidu map, and the gradual increase in travel time from 6:00 also coincides with the actual situation.

We claim:

1. A method for estimating a travel time of a road section based on built environment and low-frequency floating car data, the method comprising:

establishing a relationship between a number of reports sent by floating cars and running time, wherein the running time increases and the floating cars send reports when a road section is congested;

establishing a relationship between the running time, the built environment and intersection; and distributing the travel time of the road section, wherein the relationship between the number of report reports sent by floating cars and the running time is established by:

taking a floating car sending a report as a random variable, and establishing the relationship between a detected number of reports sent by the floating cars at each point and the running time at the point;

with probability of a floating car sending a report at one point is the same, since the floating car send reports at regular intervals, determining the frequency ε of a floating car sending a report at each moment from equation:

$$\varepsilon = \frac{1}{T}$$

where T is a time interval between two reports;

determining the probability $\rho_x$ of a floating car reporting a position at point x in direct proportional to the running time of the floating car at point x from equation:

$$\rho_x = \varepsilon t(x) = \frac{t(x)}{T}, \text{ where } t(x) < T$$

when stay time t(x) for a floating car at some point is longer than report sending periods u, i.e., t(x)>uT, where u∈$N_+$ and $$u = \left[\frac{t(x) - T}{T}\right],$$

defining u as a minimum number of report sending; wherein the probability $\rho_x$ of a float car sending reports u+1 times at point x is $$\rho_x = \varepsilon(t(x) - uT) = \frac{t(x) - uT}{T}$$

when traffic conditions are unchanged during a studied period of time, maintaining the running time of a floating car at each point unchanged, taking an event of floating cars passing each point as a random event, and when the floating cars pass during a studied period, determining events of floating cars passing by as independent repeated experiments in accordance with Bernoulli distribution;

when t(x)<T, determining the probability $p_x$ of a floating car sending $n_x$ reports at point x from equation:

$$p_x(N = n_x) = C_m^{n_x} \rho_x^{n_x} (1 - \rho_x)^{m-n_x} = C_m^{n_x} \left(\frac{t(x)}{T}\right)^{n_x} \left(1 - \left(\frac{t(x)}{T}\right)\right)^{m-n_x}$$

when t(x)>uT, where $u \in N_+$, m is the estimated number of cars, determining the probability $p_x$ of a floating car sending $n_x$ reports at point x from equation:

$$p_x(N = n_x) = C_m^{n_x - mu} \rho_x^{n_x - mu} (1 - \rho_x)^{m-n_x+mu} = C_m^{n_x - mu} \left(\frac{t(x) - uT}{T}\right)^{n_x - mu} \left(1 - \left(\frac{t(x) - uT}{T}\right)\right)^{m-n_x+mu}$$

where $0<n_x-mu<m$, i.e., $mu<n_x<m(u+1)$ with a difference of times that a floating car sends reports on each section being once at most herein using the low-frequency floating car data;

wherein the relationship between the running time, the built environment and intersection is established by:

dividing a road into a number of sections wherein the running time of each section depends on observed and unobserved attributes of each section, including a distance from the section to a downstream intersection, a distance from the section to a crosswalk, and attributes of the road to which the section belongs, including lane width, a number of lanes, geometric linearity; influence of built environment attributes on speed of the section, interference to motor vehicles caused by pedestrians and other vehicles passing in and out on the speed of the section;

by using a linear structure, representing influences of explanatory variables associated with the section running time, regulatory factors including a road grade, geometric linearity of the road and nearby land use attributes, and a length of a specific section on the section running time t'(x), which can be determined by equation:

$$t'(x) = \sum_j \alpha_j A_j \forall x \in X$$

where X represents the road; x is one of the sections of the road; $A_j$ represents a value of each explanatory variable affecting the section running time, $\alpha_j$ are the parameters to be estimated which reflect the influence degree of each explanatory variable on the section running time;

determining an observed value $t_{ok}$, $\forall k \in K$ of a road running time from equation:

$$t_{ok} = \sum_x t'(x) \times r_{kx} \forall k \in K$$

where k is the observed value of a certain running time, and K is a set of values of the running time, and determining a sum of the running time of each section as the observed running time of each road, wherein the relationship between the observed road and the section is represented with a K×X incidence matrix R, where $r_{kx}$ is the ratio of the length of each observed value k passing by section x to the total length of the section;

establishing the relationship between running time, built environment and intersection by linear combination and converting an estimation of the running time of each section to a maximum likelihood estimation problem:

$$\begin{aligned} \max \prod_x p_x &= \prod_x C_m^{n_x} \rho_x^{n_x} (1 - \rho_x)^{m-n_x} \\ &= C_m^{n_x} \left(\frac{t'(x)}{T}\right)^{n_x} \left(1 - \left(\frac{t'(x)}{T}\right)\right)^{m-n_x} \\ &= \prod_x C_m^{n_x} \rho_x^{n_x} (1 - \rho_x)^{m-n_x} \\ &= C_m^{n_x} \left(\frac{\sum_j \alpha_j A_j}{T}\right)^{n_x} \left(1 - \left(\frac{\sum_j \alpha_j A_j}{T}\right)\right)^{m-n_x}, \end{aligned}$$

where $\alpha_j$ are the parameters to be estimated; m is the estimated number of cars; $n_x$ is the number of cars which send the report;

obtaining a value of each parameter by solving the maximum likelihood estimation problem, and calculating the running time of each section using the following equation:

$$t'(x) = \sum_j \alpha_j A_j \forall x \in X$$

and the running time of the road according to the incidence matrix of the road and the sections;

wherein the travel time of the road section is distributed by:

determining a total running time T on a road by calculating an integral of the running time t"(x) at each point along the road, i.e., $T=\int_0^l t''(x)dx$;

determining a running time $t_1$ of a section within the road by calculating an integral of the running time at each point along the section, i.e., $t_1=\int_{l_1}^{l_2} t''(x)dx$;

determining an expected value of a number of the floating cars sending reports at a point by calculating a product of the probability p(x) of the floating cars sending a report at the point and the number of tests, which is a total number m of cars that pass the point: E(x)=mp(x);

determining an observed number $n_x$ of floating cars which report the positions at the point x as an unbiased estimate of the expected value and the running time of a floating car at a point in direct proportional to the probability that the floating car reports the position at this point, wherein the running time of the floating car at the point is proportional to the number of times the floating car reports its position at the point on the road, which forms a relationship: $t(x) \propto p(x) \propto E(x) \propto n_x$;

dividing the road into several sections, counting the number of times floating cars reporting their positions, and a determining a ratio of the running time of each section to a total running time of the road, which is equal a the ratio of the total number of times that the floating cars send reports on the section to the total number of times n(x) that the floating cars on the road send reports, the ratio of the running time of each section to the total running time of the road being determined from equation:

$$\alpha_1 = \frac{t_1}{T} = \frac{\int_{l_1}^{l_2} t''(x)dx}{\int_0^L t''(x)dx} = \frac{\int_{l_1}^{l_2} n(x)dx}{\int_0^L n(x)dx}$$

where $\alpha_1$ is the ratio of the running time of the first section to the total running time of the road; $t_1$ is the running time of the first section; $l_1$ and $l_2$ are the starting points of the first section and the second section, respectively; L is the end point of the last section;

wherein the travel time between different sections is distributed by:

obtaining an event of floating cars passing by any point of two or more sections from an independent repeated test under the same traffic condition, and determining a ratio of the running times of two sections, which is equal to that of the total number of reports sent by floating cars that pass through both of these two sections:

$$\frac{T_1}{T_2} = \frac{\int_0^{L_1} n'(x)dx}{\int_0^{L_1} n'(x)dx}$$

where $T_1$ and $T_2$ are the running time of the two sections, respectively; $L_1$ and $L_2$ are the length of the two sections, respectively.

* * * * *